US005758249A

United States Patent [19]

Dutton et al.

[11] Patent Number: 5,758,249

[45] Date of Patent: May 26, 1998

[54] STATUS REPORTING FROM MULTIPLE TRAY ACCESSORY

[75] Inventors: Todd Alan Dutton; Armando Villarreal Flores, both of Lexington, Ky.

[73] Assignee: Lexmark International, Inc., Lexington, Ky.

[21] Appl. No.: 853,775

[22] Filed: May 9, 1997

[51] Int. Cl.[6] ..... G03G 15/00

[52] U.S. Cl. ..... 399/391; 399/393

[58] Field of Search ..... 399/12, 13, 23, 399/90, 369, 391, 393; 271/9.11, 9.02, 9.03, 9.05, 9.06, 164, 162

[56] References Cited

U.S. PATENT DOCUMENTS

| | | | |
|---|---|---|---|
| 4,099,150 | 7/1978 | Connin . | |
| 4,798,373 | 1/1989 | Hyltoft | 271/9.05 |
| 4,966,356 | 10/1990 | Ohyabu et al. | 271/9.11 |
| 5,076,561 | 12/1991 | Matsuo | 271/9 |
| 5,150,890 | 9/1992 | Kunikawa et al. | 271/9 |
| 5,155,537 | 10/1992 | Komatsu et al. | 399/391 |
| 5,191,382 | 3/1993 | Okamura et al. | 399/107 |
| 5,201,507 | 4/1993 | Tokuda | 271/9.01 |
| 5,287,164 | 2/1994 | Watanabe | 399/391 |
| 5,365,311 | 11/1994 | Matsuoka | 399/13 |
| 5,368,285 | 11/1994 | Kusumoto | 271/9 |
| 5,379,101 | 1/1995 | Takahashi et al. | 399/110 |
| 5,383,654 | 1/1995 | Iseda | 271/9 |
| 5,393,043 | 2/1995 | Nitta | 271/9.06 |
| 5,446,524 | 8/1995 | Koike . | |
| 5,485,990 | 1/1996 | Kato | 271/9.11 X |
| 5,502,555 | 3/1996 | Lakatos . | |
| 5,512,928 | 4/1996 | Kato et al. | 347/138 |
| 5,523,822 | 6/1996 | Tsuda | 399/13 |
| 5,666,595 | 9/1997 | Sameshima et al. | 399/391 X |
| 5,699,091 | 12/1997 | Bullock et al. | 399/90 X |

*Primary Examiner*—Matthew S. Smith
*Attorney, Agent, or Firm*—John A. Brady

[57] ABSTRACT

Two stacked paper trays (43, 45) are connected electrically by cable (53) and are physically combined, as by bolts. The combined unit has a single microprocessor (49). The paper trays communicate status, such as paper size and paper amount to the microprocessor. The microprocessor reports upon interrogation from a control processor (61) of a printer (7) that it is a multiple tray unit and reports the status for each unit. This avoids the use of a microprocessor with each tray.

4 Claims, 3 Drawing Sheets

STATUS REPORTING FROM MULTIPLE TRAY ACCESSORY

TECHNICAL FIELD

This invention relates to printers having accessory units which can be optionally attached and the recognition of such attachment by the control unit of the printer.

BACKGROUND OF THE INVENTION

Electrical units may have accessories attached to them, and it is standard for a control computer on the main unit to interrogate the accessories through electrical wire paths to determine their existence and status. Typically the accessories do not have a separate microprocessor, so the interrogation is by some method not involving the capabilities of a microprocessor. For example, a moving element, such as a disk drive, may be briefly activated and its presence defined by sensing a back electrical potential characteristic of an activated drive.

Where accessory units have individual microprocessors, communication may be from microprocessor to microprocessor. The accessory unit microprocessor tracks the status of the unit and reports the results of that to the main computer. Because of the general processing capabilities of the microprocessor, status information of a unit can be very complete and quickly available. A negative aspect, however, is the significant cost of a microcomputer in each unit.

DISCLOSURE OF THE INVENTION

In accordance with this invention two stacked paper trays are connected electrically and physically, and the combined unit has a single microprocessor. The paper trays communicate status, such as paper size and paper amount held for each tray to the single microprocessor. The microprocessor reports upon interrogation from the control microprocessor of a printing system that it is a multiple tray unit and reports the status separately for each unit. This avoids the use of a microprocessor with each tray.

BRIEF DESCRIPTION OF THE DRAWING

The details of this invention will be described in connection with the accompanying drawing, in which.

BEST MODE FOR CARRYING OUT THE INVENTION

The value of having accessory units in a printer system rather than a single printer having all function permanently integrated is that the base printer has minimum cost and the user may purchase only as much equipment as needed for the functions used by that purchaser.

Figure 1:
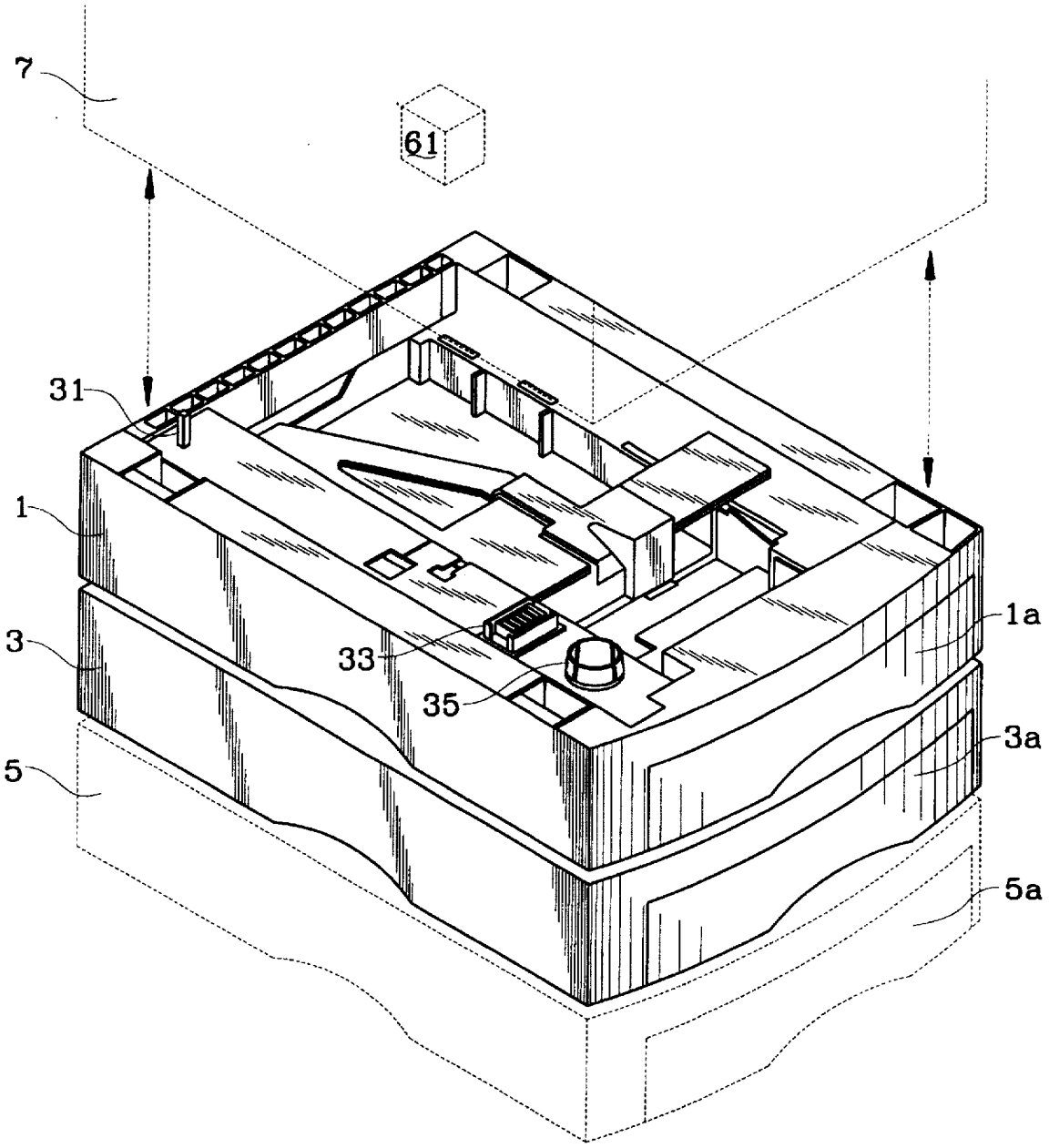
FIG. 1 illustrates stacked paper trays.

FIG. 1 shows three paper trays, 1, 3 and 5 stacked vertically upon one another and a printer 7 shown illustratively spaced away from the stack of paper trays 1, 3 and 5. Printer 7 may be a laser printer which prints on paper delivered from the paper trays 1, 3 and 5.

Figure 2:
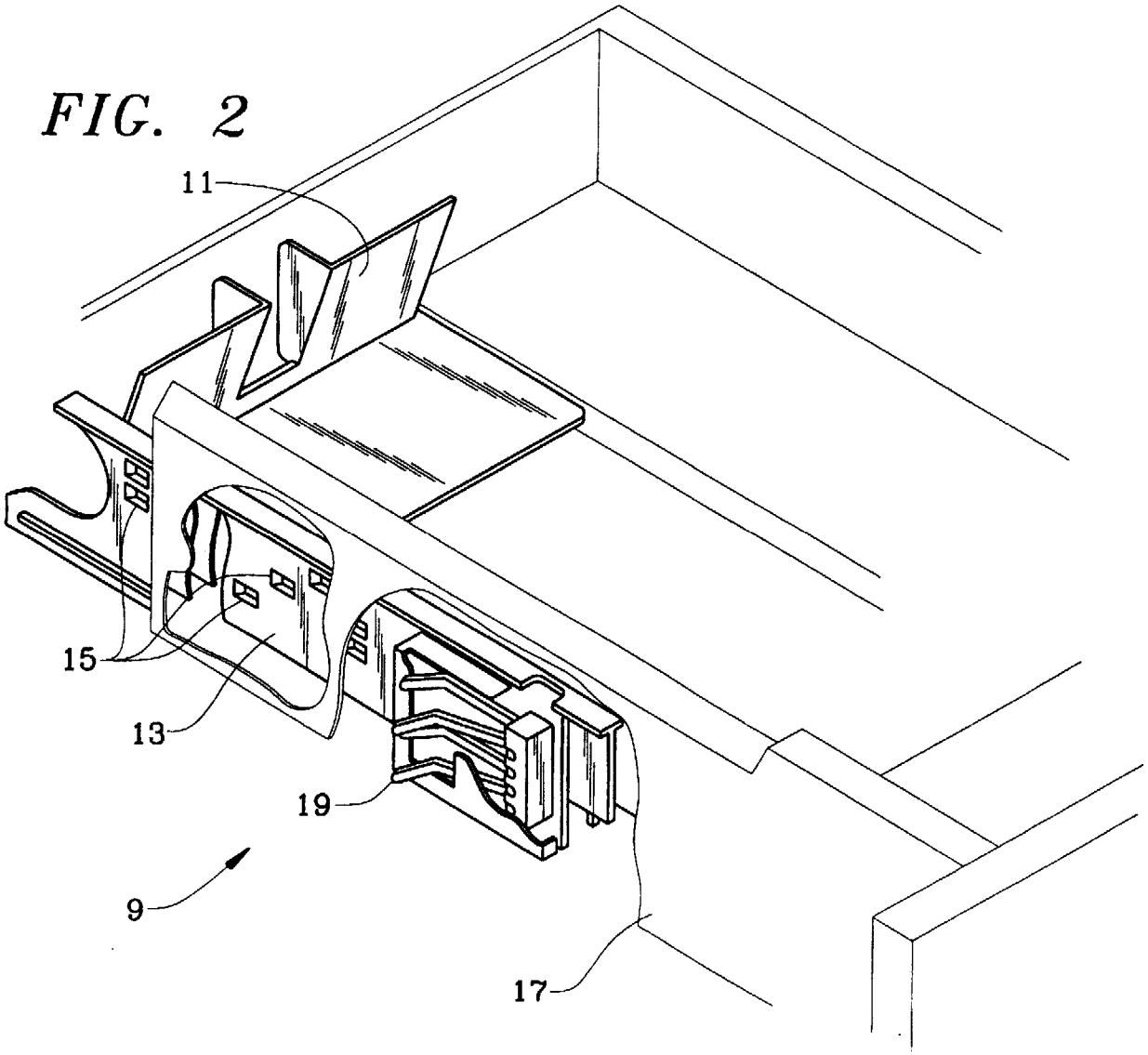
FIG. 2 is a representative paper drawer.

The paper trays 1, 3 and 5 receive drawers 1*a*, 3*a* and 5*a*. The drawers 1*a*, 3*a* and 5*a* are pulled out to load paper. A drawer 9 is shown in FIG. 2, which is representative of drawers 1*a*, 3*a* and 5*a* except that the depth of drawers 1*a*, 3*a* and 5*a* vary depending on whether they hold 250 or 500 sheets of standard paper.

Drawer 9 has an adjustable rear paper barrier 11 which is manually adjusted to abut the rear of paper loaded in drawer 9. Rear barrier 11 is moved manually by sliding, and is attached to encoded slider 13 which has depressions or holes 15 in coded patterns located corresponding to discrete paper sizes, such as for 8 ½ by 11 inch coded paper and A4 paper.

Slider 13 is held in the side wall 17 of drawer 9 for longitudinal movement with barrier 11. FIG. 2 is partially sectioned to show this relationship, as well as holes Different codes on slider 13 are defined by vertical columns having one or more holes 15.

Pivot arms 19 are held stationary in side wall 17 in a vertical column and are located to point somewhat toward the inside of drawer 9. Bent end portions of arms 19 drop into holes 15. The number of arms 19 is the same as the maximum number of holes 15 in a vertical column on slider 13, larger numbers being needed to accommodate more information. Where an arm 19 does not find a hole 15, the extreme end of that arm 19 extends past the side wall 17, where it may be readily sensed by a suitable mechanism in the tray 1*a*, 3*a* or 5*a* (preferably simply by a switch which is depressed by the end of each arm 19 not depressed into a hole 15).

The code columns of holes 15 on slider 13 are selected so that none has a hole 15 in every possible location. Therefore, when drawer 9 is installed in a tray 1*a*, 3*a* or 5*a*, the fact that one arm 19 is sensed establishes the drawer presence. When a nonstandard size paper or other media is installed in drawer 9, then all of the arms 9 are sensed and the presence of nonstandard media is known. Paper presence and the amount of paper is sensed by a rotating element (not shown) resting on the top of paper in drawer 9, the degree of rotation defining the height of the paper in drawer 9. Various techniques for sensing the amount and size of media in drawer 9 are known and virtually all may be employed in accordance with this invention.

Referring to FIG. 1 once again, the paper trays 1, 3 and 5 are seen to be stacked on each other. Each has a locating stud 31, and upper electrical socket connector 33, a mating lower electrical pin connector (not shown), and a locating socket 35 to receive a drive shaft (not shown) from the printer 7 or an accessory unit 1*a*, 3*a* immediately above it.

When printer 7 is stacked on tray 1, printer 7 has a mating electrical pin connector (not shown), which plugs into socket connector 33. Similarly, printer 7 has a shaft (not shown) which enters locating socket 35. In the same configuration, trays I and 3 have socket connectors and shafts which plug into upper electrical connector (such as 33) and shafts which enter locating sockets (such as 35) respectively of lower trays 3 and 5 respectively.

Motive power is thus translated to the units 1, 3 and 5 through a train of shafts through socket connectors 35. Electrical connection is by series connection through the electrical connectors 33.

Figure 3:
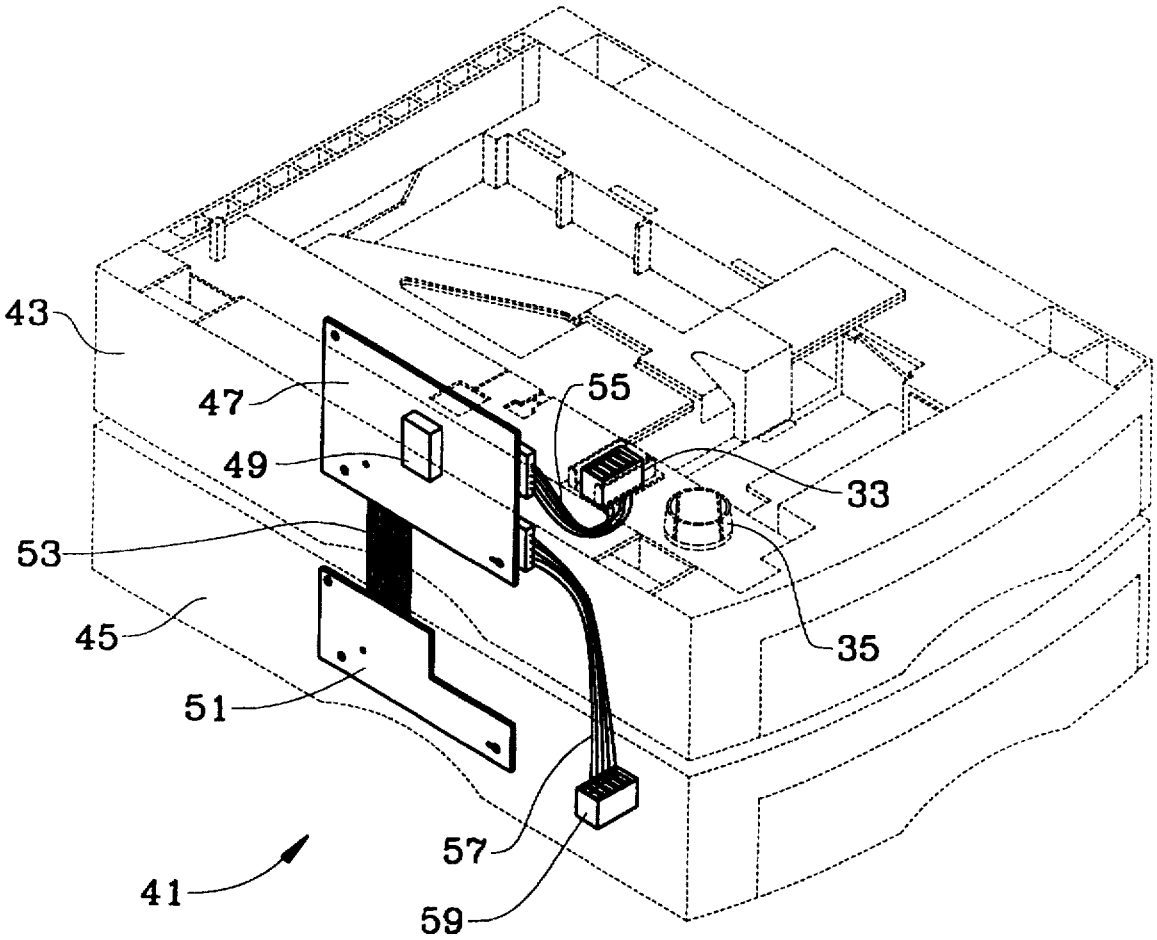
FIG. 3 illustrates the connection of two paper trays as a single unit.

The two tray accessory unit 41 in accordance with this invention is shown in FIG. 3, with left cover elements removed to illustrate electrical elements. The unit 41 has an upper paper tray 43 permanently fastened to a lower paper tray 45, in any suitable manner such as by bolts. Trays 43 and 45 may be of different media volume (one having height to hold 250 sheets and the other having height to hold 500 sheets). Except for being fastened together and for the electrical logic elements to be described, trays 43 and 45 are the same as trays 1, 3 and 5 and are stacked as are trays 1, 3 and 5. One use for unit 41 would be to replace trays 3 and 5 in the printer system described with respect to FIG. 1.

Tray 43 has a printed circuit board 47 holding conventional logic circuit elements and their connecting leads, including a microprocessor 49. The circuit board 47 with microprocessor 49 is the same overall configuration as a circuit board and microprocessor (not shown) of each of the individual trays 1, 3 and 5.

Tray 45 has a printed circuit board 51 holding conventional logic circuit elements and their connecting leads. Circuit board 51 is electrically connected to circuit board 47 through a multiline cable 53. Circuit board 51 does not contain a microprocessor. The output of the logic of board 51 is communicated to microprocessor 49 through cable 53.

The top electrical socket connector 33 is electrically connected to circuit board 47 by a cable 55. A second cable 57 is connected from circuit board 47 to the bottom of unit 41, where it has a mating connector 59 which plugs into a connector 33. As distinguished from the individual trays 1, 3 and 5, the tray 43 has no mating lower connector 59 and the tray 45 has no upper socket connector. However, unit 41 may be stacked on a further accessory, such as one of the trays 1, 3 and 5; and connector 59 of unit 41 will plug into the socket connector 33 of the lower unit, to form an operative printer system which includes unit 41 and any units so stacked under unit 41. Also, trays 43 and 45 transmit motive power through shafts (not shown) and connectors 35 in the same manner as trays 1,3, and 5.

In operation a control computer 61 (FIG. 1) in printer 7 on initiation (such as when power is initially turned on) transmits through connector 33 a predetermined initiation command. The logic of the first unit to receive that command, such as tray 1, presents an open circuit which blocks that command. The microprocessor of tray 1 recognizes the command and reports the status information of paper size, drawer presence and volume back to printer 7 through connector 33.

The microprocessor of tray 1 might then generate the initiation command and transmit it through the lower connector (such as 59 of FIG. 3) to the next lower unit, 3 in FIG. 1, or to unit 41 when unit 41 replaces trays 3 and 5. In this embodiment, the printer microprocessor 61 produces the subsequent initiation commands and the microprocessor of each unit activates logic which closes a circuit path to the power connector, such as connector 59 of FIG. 3. By either alternative, in the order in which units 1, 3, 5, 41 and other such accessory units are stacked under printer 7, the first unit receives an initiation command which the lower units do not. The first unit transmits information to printer 7 describing the first unit, the next lower unit then receives the initiation command and it transmits information to printer 7 describing that unit. This continues in sequence for all stacked units. When no description information is received after an initiation command, microprocessor 61 of printer 7 infers that no further accessory unit is in the printer system and normal printing operation is begun under the control of microprocessor 61.

The operation of unit 41 is exceptional in that it reports once identifying itself as a dual tray unit and providing description information specific to each tray.

Various alternatives to interconnect the circuit boards 47 and 51, and input signal of unit 41 will be apparent. All connection to the lower tray 45 could be by cable 53, with the connection to lower connector 59 being from board 51. Also, cables 55 and 57 could be a single cable with branching. The embodiment described is selected to be the most similar in construction to that of the single trays 1, 3 and 5, to simplify manufacture and speed design.

The microprocessor of this description are the commonly known small electronic data processors, typically formed on a single silicone chip. As such, their cost is significant and this invention avoids the use of at least one microprocessor.

Other variations of this invention will be apparent or can be anticipated.

We claim:

1. A printing system capable of attachment of multiple accessory units with electrical connection to said accessory units, said accessory units each having electronic logic elements responsive to an initiation command to block further passage of said initiation command and to respond with information describing each accessory unit and then be in a status to cause a subsequent initiation command to reach the next accessory unit in a series of said accessory units, one accessory unit in said series of accessory units comprising two paper trays physically connected in stacked relationship, each of said paper trays having variable initial information of the status of each of said paper trays, said electronic logic elements of said one accessory unit being electrically connected to both of said paper trays to receive status information unique to each said paper trays, said electronic logic elements of said one accessory unit responding to said initiation command with an identification of said one accessory unit as a two-paper tray unit and with status information as to each of said paper trays.

2. The printing system as in claim 1 in which said initiation command is from a microprocessor in a printer to which said accessory units are attached.

3. The printing system as in claim 1, in which said electronic logic elements comprise a microprocessor which identifies said initiation command, transmits said identifying information, and closes an electrical path which passes said subsequent initiation command.

4. The printing system as in claim 3 in which said initiation command is from a microprocessor in a printer to which said accessory units are attached.

* * * * *